United States Patent [19]

Walter et al.

[11] 4,203,363

[45] May 20, 1980

[54] SHEET GRIPPER FOR PRINTING CYLINDER AND THE LIKE

[75] Inventors: Siegfried Walter, Radebeul; Michael Schneider, Dresden; Hartmut Nagel, Coswig, all of German Democratic Rep.

[73] Assignee: Polygraph Leipzig Kombinat fuer Polygraphiscje Maschinen und Ausrüstungen, Leipzig, German Democratic Rep.

[21] Appl. No.: 785,085

[22] Filed: Apr. 6, 1977

Related U.S. Application Data

[63] Continuation-in-part of Ser. No. 780,245, Mar. 22, 1977, abandoned.

[30] Foreign Application Priority Data

Mar. 22, 1976 [DD] German Democratic Rep. ..... 4119195

[51] Int. Cl.[2] ..... B41F 21/04

[52] U.S. Cl. ..... 101/409; 271/277; 198/688; 269/275; 269/286; 29/120; 83/465

[58] Field of Search ..... 101/407–411; 29/118, 120; 269/285, 286, 273, 275, 274; 198/688; 271/82, 85, 277; 83/465; 294/DIG. 2

[56] References Cited

U.S. PATENT DOCUMENTS

| | | | |
|---|---|---|---|
| 2,765,000 | 10/1956 | Bond | 294/DIG. 2 |
| 2,767,653 | 10/1956 | Babicz | 101/409 |
| 3,234,694 | 2/1966 | Vosburg | 29/118 |
| 3,253,692 | 5/1966 | Ota | 198/688 |
| 3,840,224 | 10/1974 | Zawiski | 29/120 |
| 3,843,110 | 10/1974 | Smith | 269/275 |
| 3, 942,781 | 3/1976 | Gerber | 269/289 R |

FOREIGN PATENT DOCUMENTS

| | | | |
|---|---|---|---|
| 653558 | 12/1962 | Canada | 101/409 |
| 705856 | 5/1941 | Fed. Rep. of Germany | 269/286 |
| 914989 | 1/1963 | United Kingdom | 269/274 |

OTHER PUBLICATIONS

Popular Science, Jul. 1933, p. 73, "Vise jaws Lined to Aid in Soldering," E. Sterrett.

Simonds et al., "Handbook of Plastics," Van Nostrand Co., p. 210.

*Primary Examiner*—William Pieprz

*Attorney, Agent, or Firm*—Michael J. Striker

[57] ABSTRACT

A sheet gripper for a sheet-displacing apparatus such as a rotary printing machine has a pair of gripper elements whose faces are engageable with each other to grip the edge of a sheet being printed. At least one of the gripper elements is formed at its respective face of a relatively soft elastomeric material from whose surface extend hard fibers which are otherwise imbedded in the soft elastomeric material. The material may be a thermoplastic synthetic resin reinforced with glass fibers.

7 Claims, 3 Drawing Figures

FIG. 1
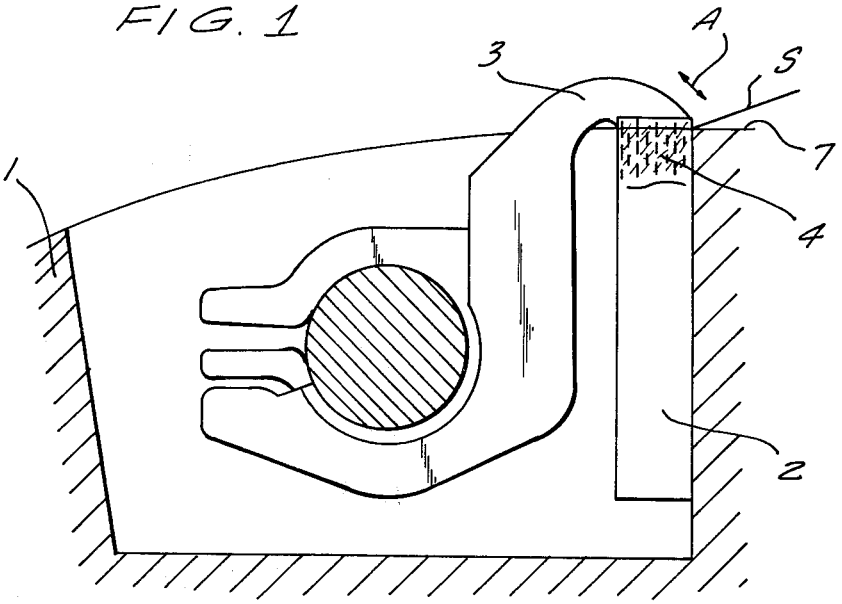
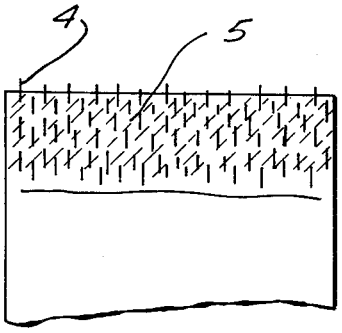
FIG. 2
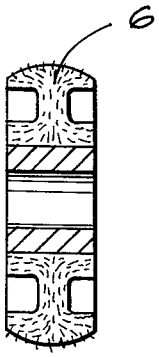
FIG. 3

SHEET GRIPPER FOR PRINTING CYLINDER AND THE LIKE

CROSS-REFERENCE TO RELATED APPLICATION

This application is a continuation-in-part of our copending application Ser. No. 780,245 filed Mar. 22, 1977, now abandoned the entire disclosure of which is herewith incorporated by reference.

BACKGROUND OF THE INVENTION

The present invention relates to a sheet gripper for a sheet-displacing apparatus. More particularly this invention concerns such a gripper used in or on a roller of a printing or like machine.

A sheet carrier cylinder or roller is often provided with one or more sheet grippers normally constituted as a pair of gripper elements whose faces are engageable with each other to grip a sheet. It is essential in modern devices such as polychrome rotary printing presses that the sheets being printed pass from one roller to another without their predetermined positionings being changed. Thus the sheet gripper must not allow the sheet to slip at all relative to the element on which such a gripper is provided.

Such grippers, as mentioned above, are normally constituted as a pair of gripper elements at least one of which is movable toward and away from the other. The gripper elements can be bars or a single bar displaceable relative to a fixed substrate, or even a roller and a bar in combination.

In view of the increasing use of two-sided printing and polychrome printing, and the employment of coated papers, the importance of and difficulty of exactly holding a sheet has increased. It has been suggested to increase the gripping effect of a gripper by increasing the coefficient of surface friction of such an arrangement, or by shaping the face of at least one of the grippers. Such arrangements in practice have proven relatively expensive, and have often lead to embossing of the workpiece edge with the shape of the gripper element.

SUMMARY OF THE INVENTION

It is therefore an object of the present invention to provide an improved gripper for a sheet-displacing apparatus.

Yet another object is to provide a gripper such as is usable in a polychrome rotary press.

Another object of this invention is the provision of an improved sheet gripper which can be produced at low cost and which will not damage the workpiece.

These objects are attained according to the present invention by forming at least one of the gripper elements at its respective face of a relatively soft elastomeric material in which is embedded a multiplicity of relatively hard fibers extending from the respective face toward the face of the other gripper element. Thus these fibers insure a good engagement between the one gripper element and the sheet being displaced.

In accordance with other features of this invention at least one of the elements is formed at least at its face of a glass-fiber reinforced thermoplastic synthetic resin. The fibers projecting from the face of the one element extend generally perpendicularly to this face. Thus slippage along the face and, therefore, along a surface coplanar or contiguous with this face is largely ruled out.

The gripper elements according to this invention may be formed as parallel bars with mutually engageable planar faces, or one of the gripper elements may be constituted as a roller with radially projecting fibers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a cross-section through a gripper according to this invention;

FIG. 2 is a large-scale partly sectional view of a portion of the gripper of FIG. 1; and FIG. 3 is an axial section through another gripper element in accordance with the present invention.

DESCRIPTION OF THE PREFERRED EMBODIMENTS

As shown in FIGS. 1 and 2 a press roller 1 according to this invention and substantially corresponding to the sheet-carrier cylinder shown in U.S. Pat. No. 3,654,861 has an outer surface 7 on which a sheet S is adapted to lie. This roller 1 is provided with a gripper in the form of a relatively stationary gripper element 2 and a displaceable gripper element 3 which can be moved radially toward and away from the element 2 as indicated by the arrow A in FIG. 1. The actuation and operation of the gripper is described in the above-cited patent.

In accordance with the present invention the element 2 is formed of a relatively soft thermoplastic synthetic resin reinforced with glass fibers. This element 2 has a surface 5 from which extend relatively hard fibers 4, these fibers 4 being generally perpendicular to the surface 5.

Such an element 2 is made in accordance with this invention by injection molding during which at least the majority of the fibers 4 become automatically oriented in the direction of flow of the injected material, i.e., normal to the surface 5. After curing of the element 2 its surface 5 is abraded, removing the relatively soft synthetic-resin material forming the body 2, and leaving the relatively hard fibers 4 projecting therefrom.

It is also possible in accordance with this invention to form the face of the element 3 in the same manner.

FIG. 3 shows how a roller 6 can be made in the same manner, with the fibers projecting generally radially from the roller 6.

It will be understood that each of the elements described above, or two or more together, may also find a useful application in other types of structures differing from the types described above.

While the invention has been illustrated and described as embodied in a sheet gripper, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sheet gripper for a sheet-displacing apparatus wherein a pair of gripper elements have faces engageable with each other to grip a sheet, the improvement wherein at least one of said gripper elements is formed at its respective face of a relatively soft elastomeric material in which is embedded a multiplicity of relatively hard but flexible fibers extending from the respective face toward the other face.

2. In a sheet gripper for a sheet displacing apparatus wherein a pair of gripper elements have faces engageable with each other to grip a sheet, the improvement wherein at least one of said gripper elements is formed at its respective face of a relatively soft elastomeric material in which is imbedded a multiplicity of hard but flexible glass fibers extending from the respective face towards the other face and wherein said material is a thermoplastic synthetic resin reinforced by said fibers.

3. The improvement defined in claim 2, wherein said elements are bars.

4. The improvement defined in claim 3, wherein at least one of said bars is completely formed of said relatively soft material.

5. The improvement defined in claim 2, wherein said one element is a roller.

6. The improvement defined in claim 2, wherein both of said elements are formed at their respective faces of such elastomeric material with such fibers.

7. The improvement defined in claim 2, wherein at least a majority of said fibers project generally perpendicularly from the respective face.

* * * * *